US010920598B2

(12) United States Patent
Whitten et al.

(10) Patent No.: US 10,920,598 B2
(45) Date of Patent: Feb. 16, 2021

(54) ROTOR ASSEMBLY COVER PLATE

(71) Applicant: Rolls-Royce Corporation, Indianapolis, IN (US)

(72) Inventors: Michael R. Whitten, Zionsville, IN (US); Brandon Snyder, Greenwood, IN (US); James Sellhorn, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 326 days.

(21) Appl. No.: 15/584,929

(22) Filed: May 2, 2017

(65) Prior Publication Data

US 2018/0320532 A1 Nov. 8, 2018

(51) Int. Cl.
*F01D 5/30* (2006.01)
*F01D 11/00* (2006.01)

(52) U.S. Cl.
CPC ..... *F01D 5/3015* (2013.01); *F01D 11/006* (2013.01); *F05D 2220/32* (2013.01); *F05D 2240/20* (2013.01); *F05D 2240/55* (2013.01); *F05D 2250/23* (2013.01); *F05D 2260/36* (2013.01)

(58) Field of Classification Search
CPC ..... F01D 5/3015; F01D 5/32; F01D 5/323; F01D 5/326; F01D 5/3007; F05D 2260/36
See application file for complete search history.

(56) References Cited

U.S. PATENT DOCUMENTS

| | | | | |
|---|---|---|---|---|
| 5,503,528 | A | 4/1996 | Glezer et al. | |
| 5,833,244 | A | 11/1998 | Salt et al. | |
| 6,190,131 | B1 * | 2/2001 | Deallenbach | F01D 5/027 416/144 |
| 6,416,282 | B1 * | 7/2002 | Beeck | F01D 5/087 415/115 |
| 7,052,240 | B2 | 5/2006 | Race et al. | |
| 7,520,718 | B2 | 4/2009 | Engle | |
| 7,566,201 | B2 * | 7/2009 | Brillert | F01D 5/081 29/889.2 |
| 8,007,230 | B2 * | 8/2011 | Hafner | F01D 5/08 415/173.7 |
| 8,602,737 | B2 * | 12/2013 | Garcia-Crespo | F01D 5/3015 416/204 R |
| 8,740,554 | B2 | 6/2014 | Virkler et al. | |
| 9,803,485 | B2 * | 10/2017 | Snyder | F01D 5/3015 |
| 2010/0047073 | A1 * | 2/2010 | Bluck | F01D 5/3015 416/220 R |
| 2010/0196164 | A1 * | 8/2010 | Liotta | F01D 5/3015 416/220 R |
| 2016/0090850 | A1 * | 3/2016 | Barry | F01D 5/081 416/221 |
| 2016/0186590 | A1 | 6/2016 | Himes | |
| 2016/0273370 | A1 * | 9/2016 | Belshaw | F01D 5/081 |

* cited by examiner

*Primary Examiner* — Nathaniel E Wiehe
*Assistant Examiner* — Jackson N Gillenwaters
(74) *Attorney, Agent, or Firm* — Shumaker & Sieffert, P.A.

(57) ABSTRACT

A cover plate for maintaining axial alignment between a blade assembly and a rotor disk and transferring centrifugal loading directly to the rotor disk. The cover plate comprises a plate key extending axially from an elongate member, the plate key configured to engage a keyway of the rotor disk assembly and/or a notch of the blade key.

9 Claims, 15 Drawing Sheets

ROTOR ASSEMBLY COVER PLATE

FIELD OF THE DISCLOSURE

The present disclosure relates generally to turbine machines, and more specifically to a cover plate assembly for a gas turbine engine rotor assembly.

BACKGROUND

Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor section and the turbine section may each include alternating rows of rotor and stator assemblies. The rotor assemblies carry rotating blades that create or extract energy (in the form of pressure) from the core airflow that is communicated through the gas turbine engine. The stator assemblies include stationary structures called stators or vanes that direct the core airflow to the blades to either add or extract energy.

Rotor assemblies typically include rotor disks that extend between disk rims and disk bores. Blades are mounted near the rim of a rotor disk. Cover plates may be used to seal the connection between the blades and the rotor disks that carry the blades, and to prevent axial movement of the blades relative to the rotor disks.

BRIEF DESCRIPTION OF THE DRAWINGS

The following will be apparent from elements of the figures, which are provided for illustrative purposes and are not necessarily to scale.

FIG. 5F illustrates the rotor assembly coverplate with multiple plate keys engaging multiple blade keys in accordance with some embodiments of the present disclosure.

Figure 1A:
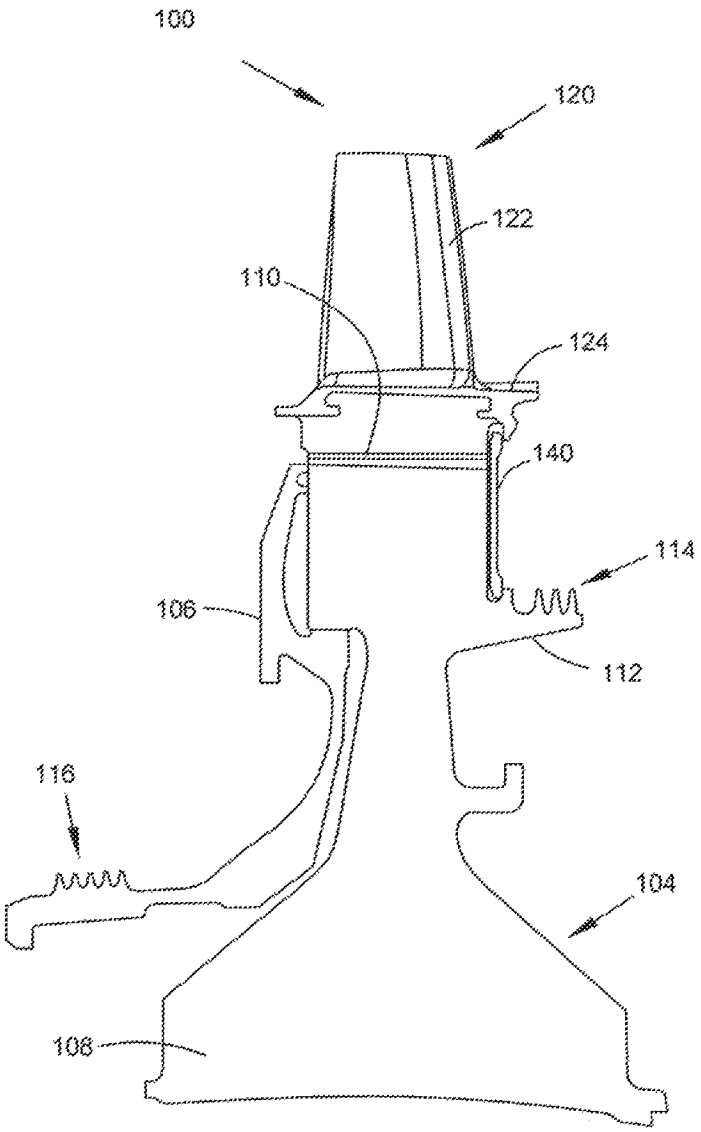
FIG. 1A is a cross-sectional view of a rotor assembly.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

Figure 1B:
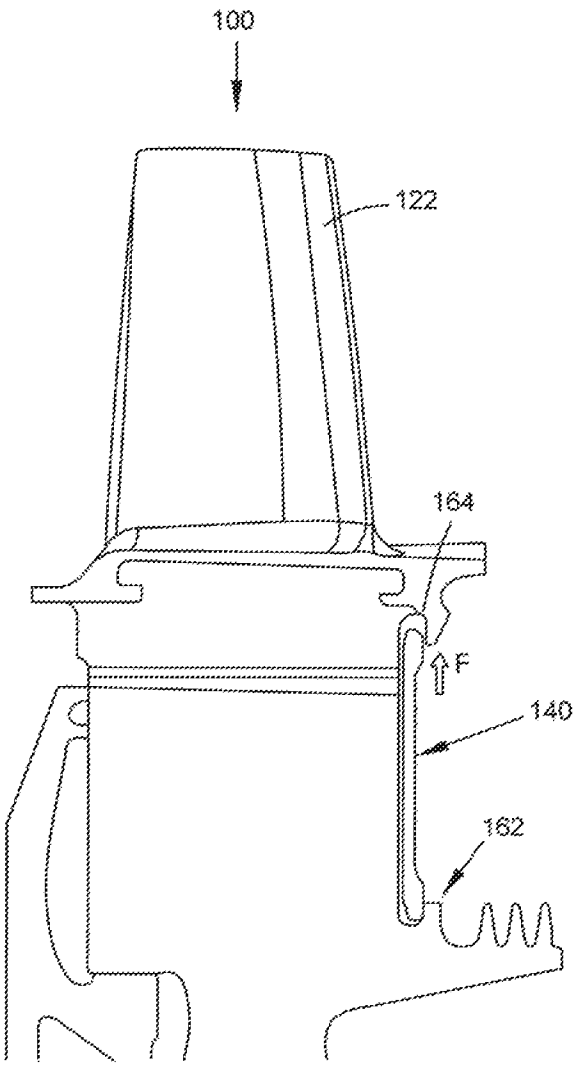
FIG. 1B is a detailed cross-sectional view of a rotor assembly.

A rotor assembly 100 is illustrated in FIGS. 1A and 1B. More specifically, FIG. 1A provides a cross-sectional view of a rotor assembly 100, while FIG. 1B provides a detailed cross-sectional view of the rim 102 of a rotor assembly 100. In one embodiment, the rotor assembly 100 is a turbine assembly of the turbine section of a gas turbine engine. However, this disclosure is not limited to turbine assemblies, and the various features of this disclosure could extend to other assemblies or sections of a gas turbine engine, including but not limited to compressor assemblies. It will be appreciated that rotor assembly 100 is not necessarily drawn to scale and has been enlarged to better illustrate its various features and components.

Rotor assembly 100 comprises a rotor disk 104, a blade assembly 120, and a rotor assembly cover plate 140. In some embodiments rotor assembly 100 further comprises a forward sealing plate 106. Rotor assembly 100 may further comprise a stator assembly (not shown) positioned radially forward and/or radially aft of the rotor assembly 100. A pairing of a rotor assembly 100 with a stator assembly is called a stage, and the compressor section and turbine section of a turbine engine typically comprise multiple stages.

Rotor disk 104 extends radially outward from a disk bore 108 to a disk rim 110. The disk rim 110 is the most radially outward portion of the rotor disk 104. In the vicinity of the disk rim 110, rotor disk 104 may define one or more keyways (not visible in FIGS. 1A and 1B) that are circumferentially disposed about the disk 104 and configured to receive the key of a blade assembly 120.

Rotor disk 104 may include mechanisms for sealing in an axially forward or aft direction. For example, the rotor disk 104 illustrated in FIG. 1A comprises an aft sealing arm 112 that extends axially aft from disk 104 and has a plurality of sealing ridges 114, or knives, that form a labyrinth seal when mated to a sealing surface of an adjacent component. Axially forward support, positioning, and sealing are provided to the rotor disk 104 illustrated in FIG. 1A by a forward sealing plate 106. Forward sealing plate 106 also comprises a plurality of sealing ridges 116, or knives, that form a labyrinth seal when mated to a sealing surface of an adjacent component.

Blade assembly 120 comprises a blade 122, blade skirt 124, and blade key (not shown in FIGS. 1A and 1B). Blade assembly 120 is coupled to rotor assembly 100 with blade key disposed in disk keyway. The blade 122 is configured to extract energy (in the form of pressure) from the core airflow that is communicated through the gas turbine engine. Blade skirt 124 extends in a generally circumferential fashion and may form the radially inner flow boundary of the core airflow. Blade skirt 124 is disposed between blade 122 and the blade key.

Rotor assembly 100 typically comprises a plurality of blade assemblies 120 spaced about the circumference of the rotor disk 104, with each blade assembly 120 coupled to the rotor disk 104 by a respective blade key and disk keyway. With the disk keyway disposed in the blade key, radial movement of the rotor disk 104 is restricted.

Cover plate 140 is disposed between rotor disk 104 and blade assembly 120, and is configured to reduce, restrain, or prevent axial movement of blade assembly 120 relative to rotor disk 104. In the rotor assembly illustrated in FIGS. 1A and 1B, the cover plate 140 has a radially inner portion disposed in a disk groove 162 and a radially outer portion disposed in a blade groove 164. Cover plate 140 may be referred to as a cover plate segment, as a plurality of segments are arranged circumferentially about the rotor disk 104 to form an annular cover plate ring. The cover plate ring is configured to reduce, restrain, or prevent axial movement of the plurality of blade assemblies 120 spaced about the circumference of rotor disk 104 relative to rotor disk 104.

The cover plate 140 and rotor assembly 100 illustrated in FIGS. 1A and 1B has drawbacks. Notably, during operation of the turbine engine the cover plate 140 loads, under centrifugal force, the blade groove 164. Arrow "F" of FIG. 1B illustrates the direction of this force. The load of the cover plate 140 is transferred to the blade assembly 120, and then via the blade key/rotor disk keyway interface to the rotor disk 104. To carry this loading, the blade assembly 120, and particularly the blade skirt 124, may require reinforcement, additional structures, and/or greater radial thickness. Additionally, loading the blade groove 164 may be undesirable as it may result in premature failure of the blade groove 164 or blade assembly 120 more generally.

Thus it is desirable to provide a loading pathway whereby the cover plate 140 transfers load directly to the blade disk 104 rather than transferring load to the blade disk 104 via the blade assembly 120. Such a modification to the rotor assembly 100 depicted in FIGS. 1A and 1B may allow for a lighter (e.g. less reinforced) blade assembly 120 that is less prone to premature failure caused by loading at the blade groove 164.

The present disclosure is thus directed to rotor assembly cover plates, rotor assemblies, systems, and methods of transferring load directly from a cover plate to a rotor disk and avoiding the transfer of load from a cover plate to a blade assembly. More specifically, the present disclosure is directed to rotor assembly cover plates having one or more plate keys configured to engage the keyway of a rotor disk, thus directly transferring the centrifugal force loading of the cover plate to the rotor disk in lieu of the blade assembly.

Figure 2A:
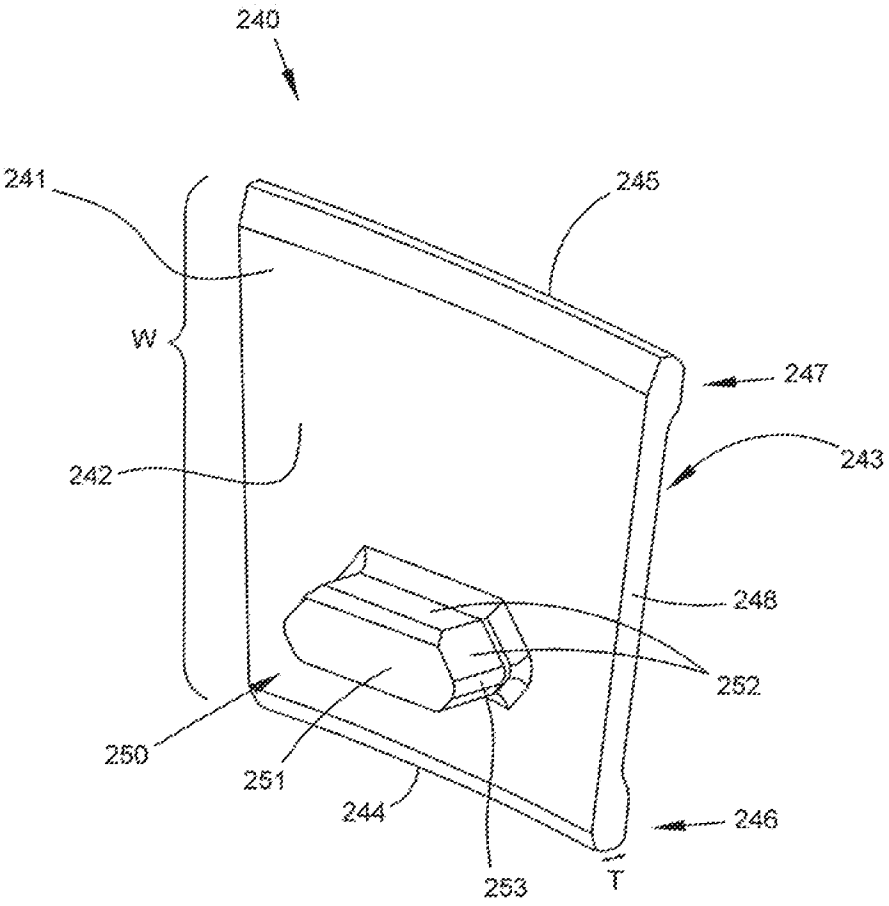
FIG. 2A is an isometric view of a rotor assembly cover plate with a single-tooth plate key in accordance with some embodiments of the present disclosure.

FIG. 2A provides an isometric view of a rotor assembly cover plate 240 in accordance with some embodiments of the present disclosure. The cover plate 240 of FIG. 2A may also be referred to as a cover plate segment. A plurality of cover plate segments may be arranged about the circumference of the rotor assembly to form an annular cover plate ring.

Cover plate 240 comprises an elongate member 241 extending in a generally axial direction between a forward plate face 242 and an aft plate face 243, and in a generally radial direction between a radially inner edge 244 and a radially outer edge 245. A radially inner portion 246 proximate the radially inner edge 244 and a radially outer portion 247 proximate the radially outer edge 245 may include tapered or chamfered surfaces. A central portion 248 extends between radially inner portion 246 and radially outer portion 247. Forward plate face 242 may be referred to as a front plate face and aft plate face 243 may be referred to as a back plate face.

A thickness T of the cover plate 240 is defined as the dimension between the forward plate face 242 and aft plate face 243. In some embodiments, one or both of the radially inner portion 246 and radially outer portion 247 may have a thickness T that is different from the thickness T of central portion 248. In some embodiments, one or both of the radially inner portion 246 and radially outer portion 247 may have a thickness T that is greater than the thickness T of central portion 248.

A radial width W of cover plate 240 is defined as the dimension between the radially inner edge 244 and radially outer edge 245.

A plate key 250 extends axially forward from the forward plate face 242. In some embodiments the plate key 250 may be normal or substantially normal to the forward plate face 242. Plate key 250 comprises a forward key face 251 and a plurality of exterior surfaces 252. Exterior surfaces 252 may form an axially-extending ridge 253, or tooth, that may be configured to engage the keyway of rotor disk 104, or to match or substantially match the profile of the blade key. Plate key 250 may present, at a cross-section normal to the axis of rotation, a shape such as a trapezoid, rhombus, or polygon, to name merely a few non-limiting examples. One or more of exterior surfaces 252 may be tapered towards or chamfered to the forward key face 251.

Figure 2B:
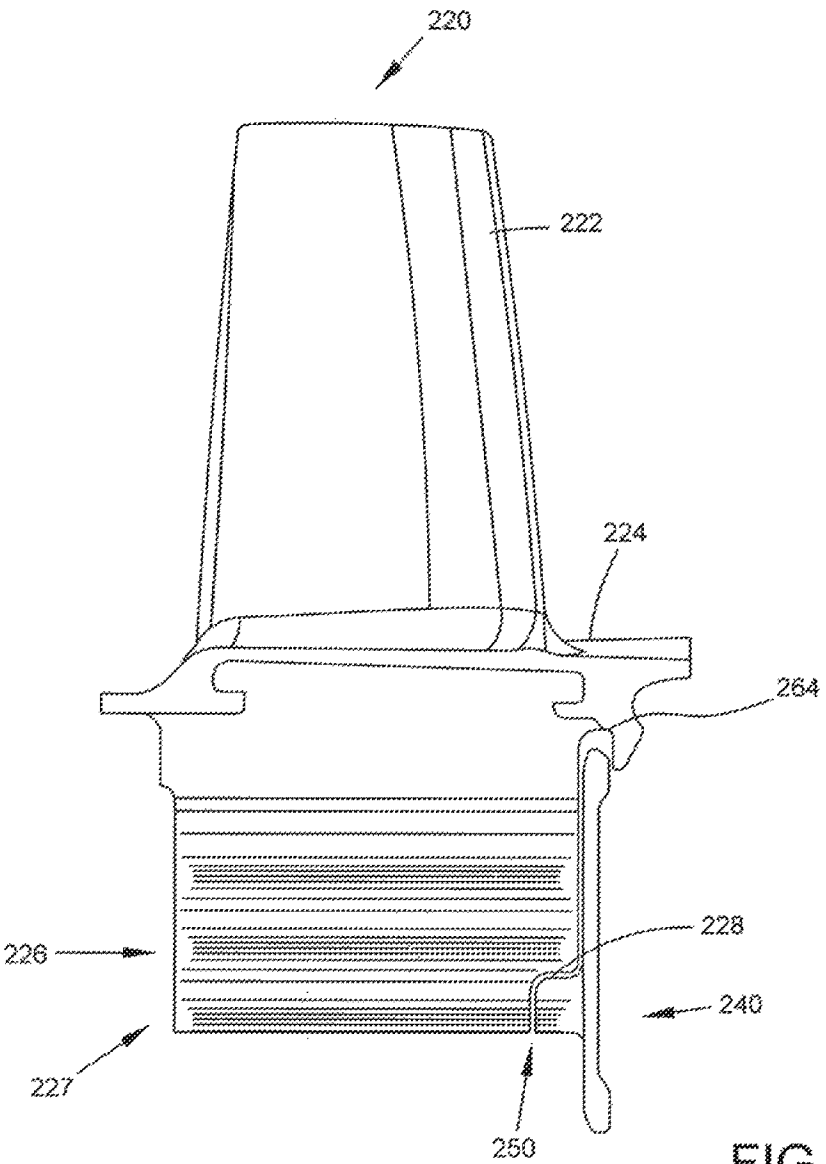
FIG. 2B is a profile view of a blade assembly with the rotor assembly cover plate depicted in FIG. 2A, in accordance with some embodiments of the present disclosure.

The plate key 250 may be sized and shaped to compliment the blade key, which is pictured in FIG. 2B. That is, the plate key 250 may be dimensioned such that one or more surfaces of the plate key 250 are axially aligned with surfaces of the blade key, or such that the plate key 250 interacts with the keyway of rotor disk 104 in a similar manner as the blade key.

FIG. 2B provides a profile view of a blade assembly 220 adjacent the cover plate 240 of FIG. 2A. A blade key 226 extends radially inward from the blade skirt 224 and, in the illustrated embodiment, comprises three axially-extending ridges 227 configured to engage a similarly-shaped rotor disk keyway. The blade key 226 further comprises a notch 228 configured to accommodate the plate key 250 of cover plate 200. Ridges 227 may alternatively be referred to as teeth.

The plate key 250 may be dimensioned to substantially match the cross-section of the radially innermost ridge 227 of the blade key 226 when viewed in cross-section normal to the axis of rotation. Similarly, the plate key 250 may be dimensioned such that the exterior surfaces of the plate key 250 axially align with the exterior surfaces of one or more ridges 227 of the blade key 226.

When installed in the keyway of a rotor disk, the ridges 227 of blade key 226 radially retain the blade assembly 220 during rotation of the rotor assembly. In other words, under the influence of centrifugal forces from rotation of the rotor assembly, the blade assembly 220 does not move radially outward and separate from the rotor assembly because of blade key 226 engagement with a keyway of the rotor disk. Similarly, the engagement of exterior surfaces 252 of the plate key 250 radially retains the cover plate 240 during rotation of the rotor assembly. Centrifugal force loading is transferred to the rotor disk via the plate key 250 and rotor disk keyway.

Figure 2C:
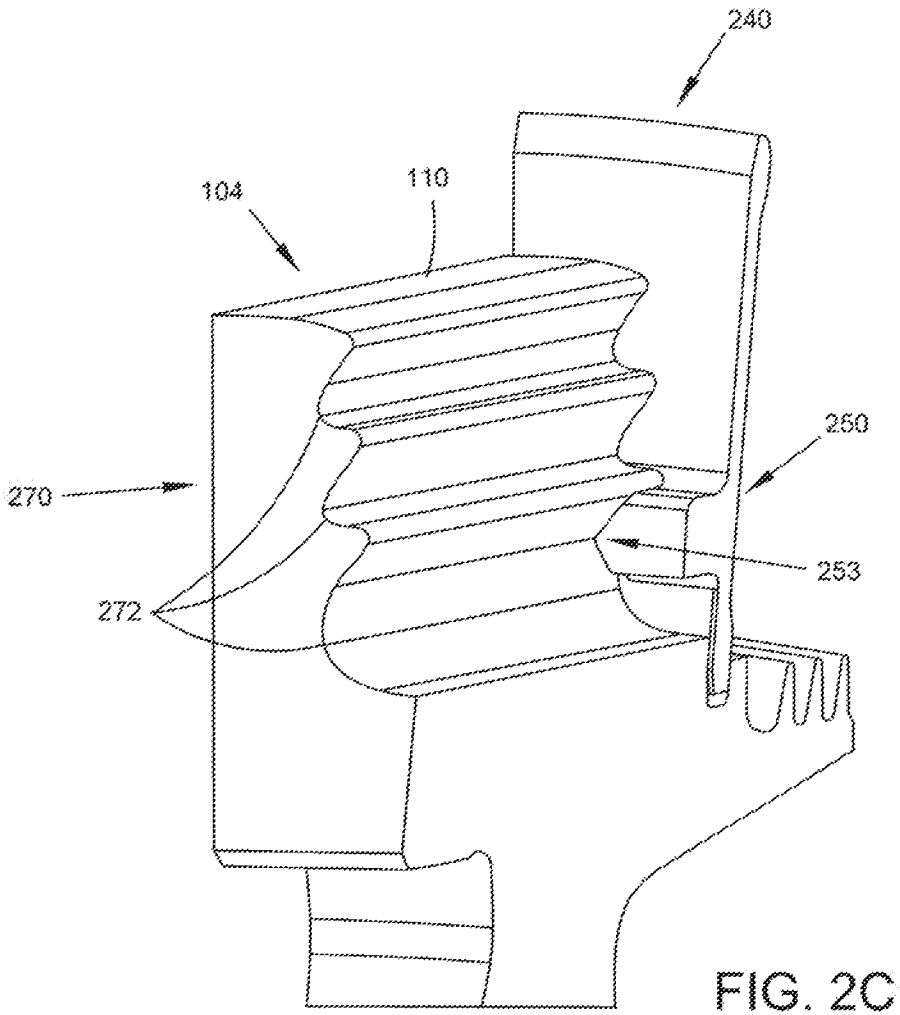
FIG. 2C is an isometric and cross-sectional view of a rotor disk and the rotor assembly cover plate depicted in FIG. 2A, in accordance with some embodiments of the present disclosure.

FIG. 2C provides an isometric and cross-sectional view of a rotor disk 104 and the rotor assembly cover plate 240 of FIG. 2A. As described above, rotor disk 104 in relevant part illustrated in FIG. 2C comprises a disk rim 110 and a keyway 270 proximate the disk rim 110. In the illustrated embodiment, keyway 270 comprises three axially-extending recesses 272 configured to correspond to the axially-extending ridges 227 of blade key 226.

As shown in FIG. 2C, plate key 250 may be dimensioned to engage one or more of recesses 272, in a similar fashion as to the engagement of ridges 227 with recesses 272. Cover plate 240 is shown extending radially beyond disk rim 110 so as to axially retain blade assembly 220 which is not illustrated in FIG. 2C. The engagement of plate key 250 with keyway 270 allows for the direct transfer of centrifugal loading from the cover plate 240 to the rotor disk. This load path contrasts with the load path described above with reference to FIGS. 1A and 1B, wherein the load is transferred from the cover plate 140 to the blade groove 164 defined by the blade skirt 124 and then through the blade key to the rotor disk 104.

In some embodiments such as those illustrated in FIGS. 2B and 2C, the blade key 226 is shaped as referred to in the art as the fir tree key or fir tree roots, and the rotor disk keyway 270 is shaped to correspond with the blade key 226, as referred to in the art as the fir tree keyway.

Figure 3:
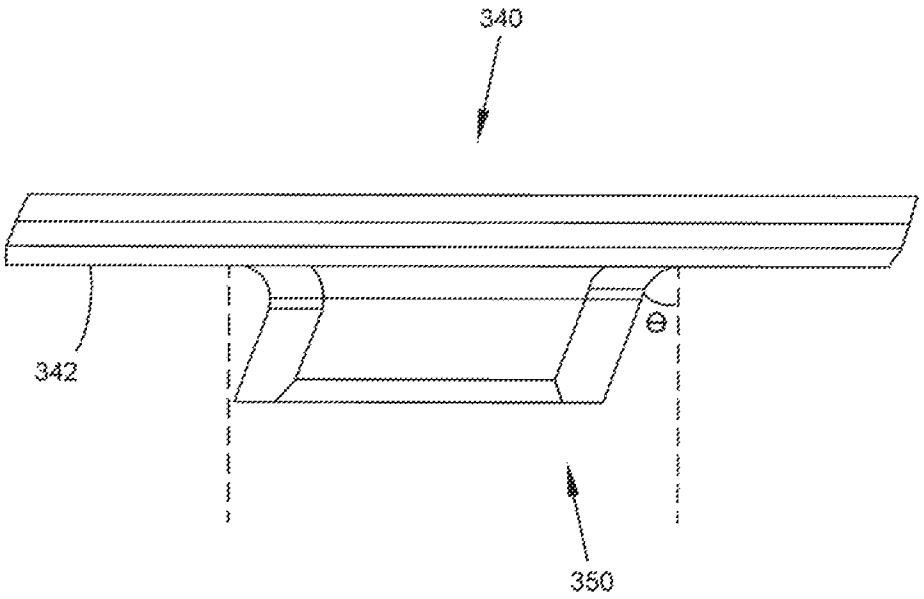
FIG. 3 is a radial profile view of a rotor assembly cover plate in accordance with some embodiments of the present disclosure.

FIG. 3 is a top profile view of an alternative cover plate 340 in accordance with some embodiments of the present disclosure. A disclosed above, in some embodiments the plate key may extend normal or substantially normal to the forward plate face of the cover plate. However, in some embodiments, such as that depicted in FIG. 3, one or more exterior surfaces of the plate key 350 may axially extend away from the forward plate face 342 at an angle θ relative to the forward plate face 342 or relative to a plane normal to the forward plate face 342.

Figure 4A:
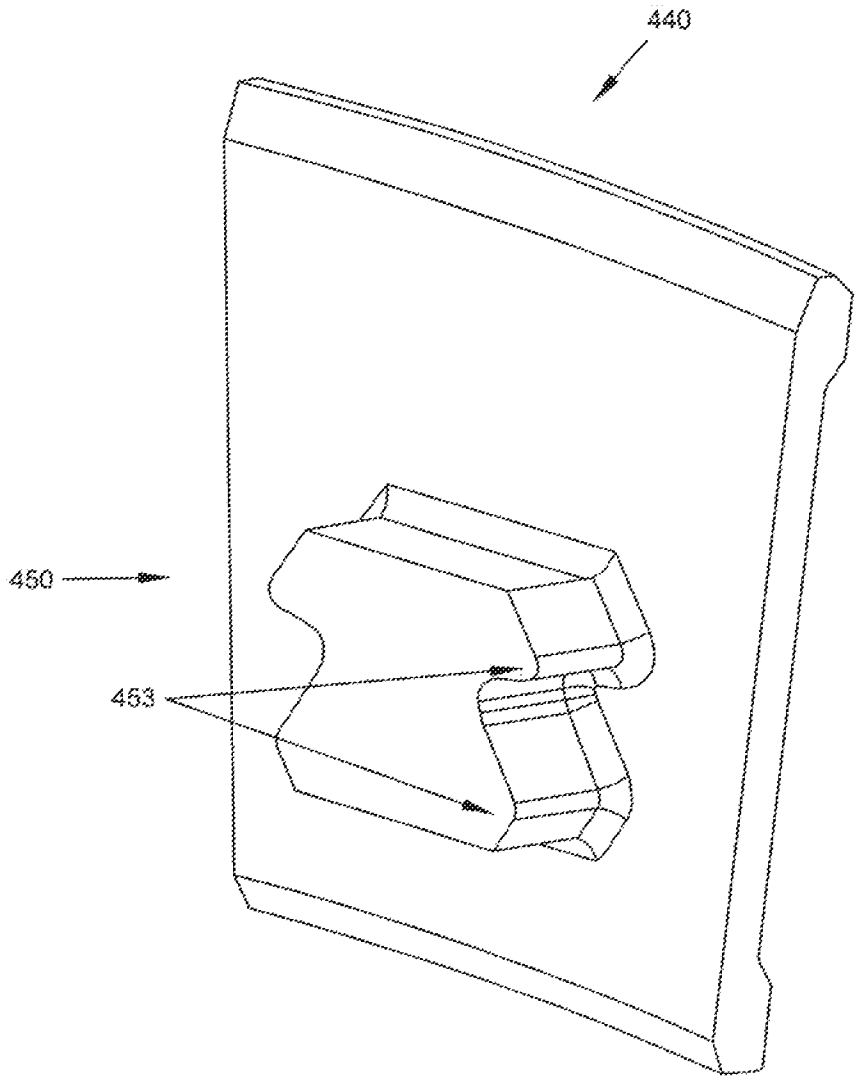
FIG. 4A is an isometric view of a rotor assembly cover plate with a double-tooth plate key in accordance with some embodiments of the present disclosure.
Figure 4B:
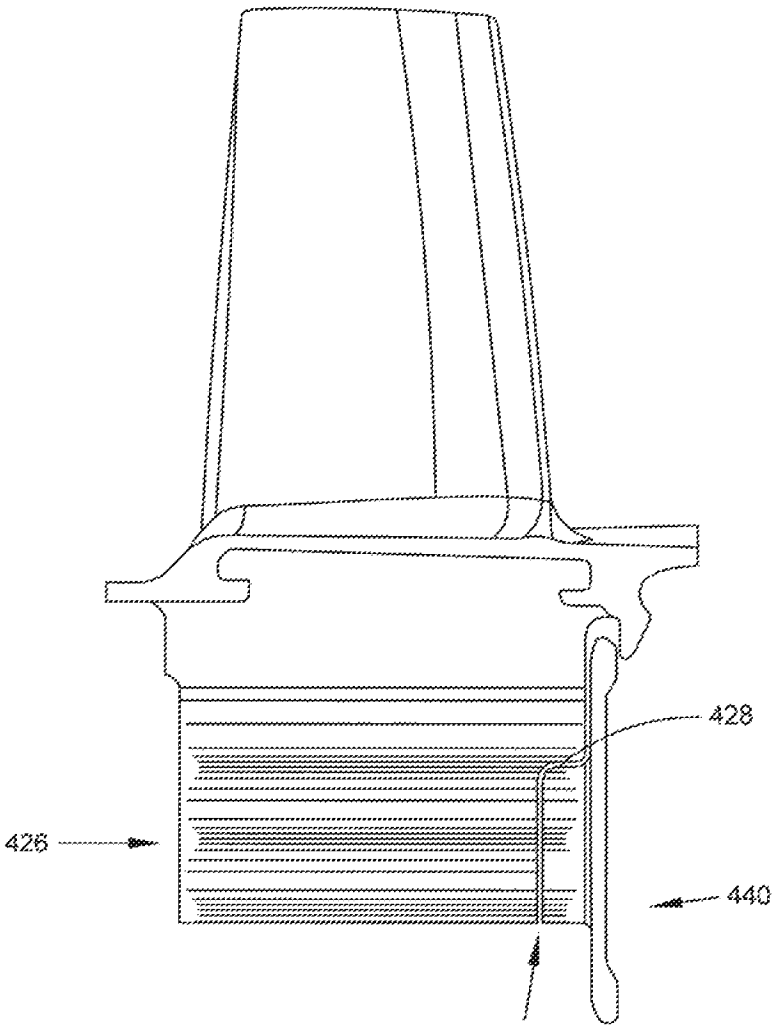
FIG. 4B is a profile view of a blade assembly with the rotor assembly cover plate depicted in FIG. 4A, in accordance with some embodiments of the present disclosure.
Figure 4C:
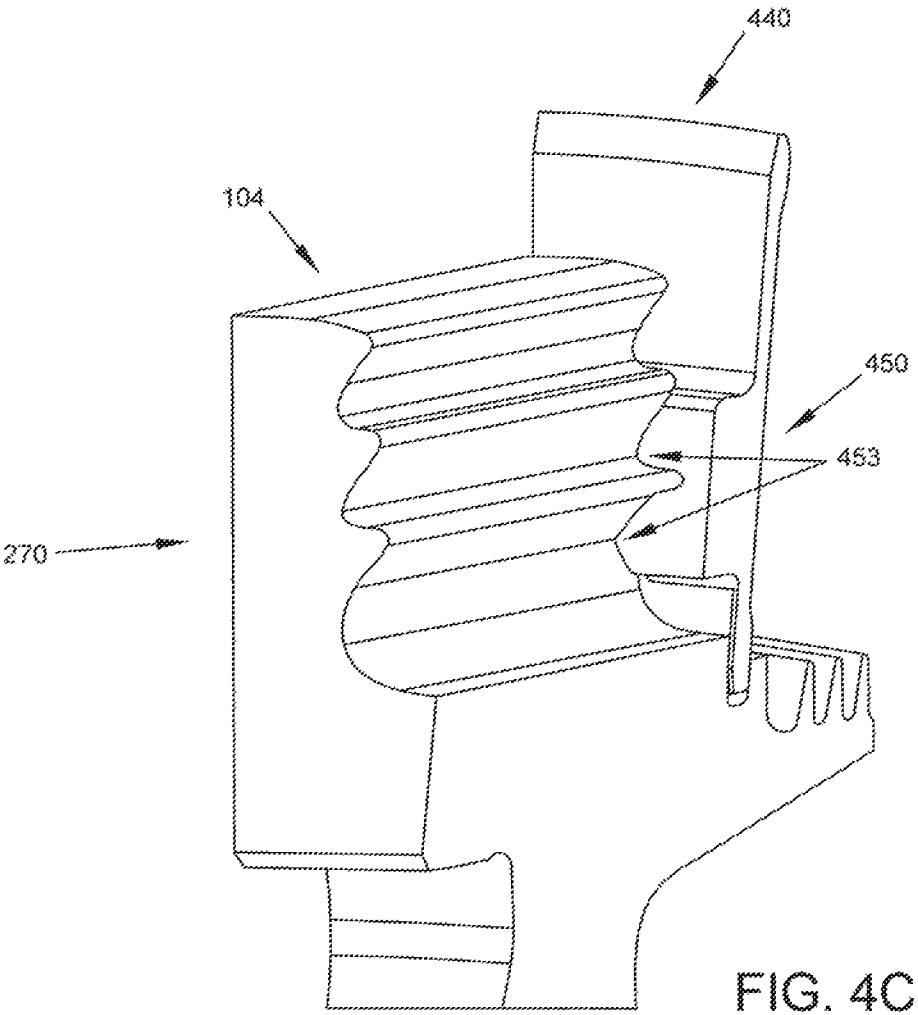
FIG. 4C is an isometric and cross-sectional view of a rotor disk and the rotor assembly cover plate depicted in FIG. 4A, in accordance with some embodiments of the present disclosure.

FIGS. 4A, 4B, and 4C present an alternative embodiment of cover plate 240, referred to herein as cover plate 440. Cover plate 440 is substantially as described above with reference to cover plate 240 presented in FIGS. 2A, 2B, and 2C. However, cover plate 440 comprises a plate key 450 dimensioned differently than plate key 250. Specifically, plate key 450 as seen in FIG. 4A comprises a pair of ridges 453, or teeth, vice the single ridge 253 of plate key 250. Thus, as seen in FIG. 4B, the pair of ridges 453 align with the ridges of the blade key 426. The blade key 426 includes an extended notch 428 as compared to notch 228 in order to accommodate the larger plate key 450.

FIG. 4C provides an isometric and cross-sectional view of a rotor disk 104 and the rotor assembly cover plate 450 of FIG. 4A. The plate key 450 and plate key ridges 453 may be dimensioned to engage one or more of recesses 272, in a similar fashion as to the engagement of ridges 227 with recesses 272.

In an alternative embodiment, a cover plate may be configured to transfer load to the blade key instead of to the blade skirt. The load is then transferred from the blade key to the rotor disk. In such an embodiment, load is not transferred directly from the cover plate to the rotor disk, but improvements are still realized because loading is not transferred to the blade groove and thus reinforcement of the blade skirt is not required. Such an alternative embodiment is presented in FIGS. 5A, 5B, 5C, 5D, and 5E.

Figure 5A:
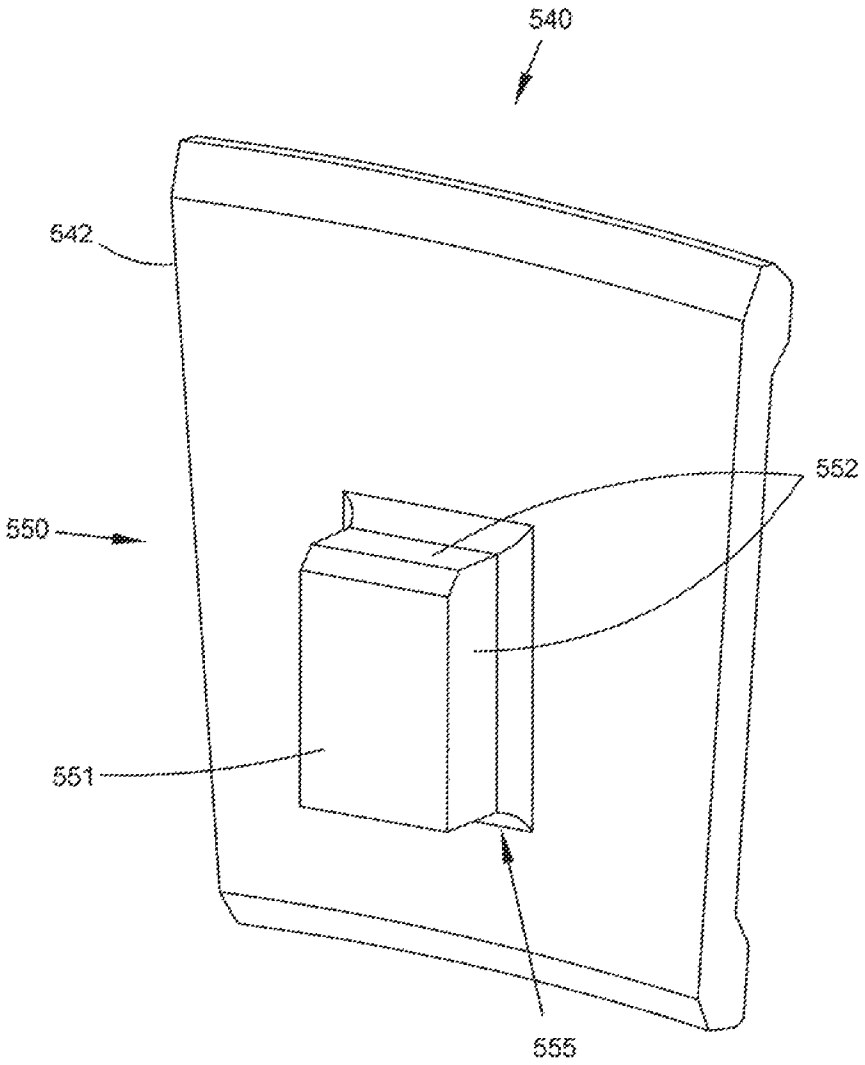
FIG. 5A is an isometric view of a rotor assembly cover plate with an untoothed plate key in accordance with some embodiments of the present disclosure.

FIG. 5A presents an isometric view of a cover plate 540 that is substantially as described above with reference to cover plate 240 of FIGS. 2A, 2B, and 2C, and cover plate 440 of FIGS. 4A, 4B, and 4C. However, the plate key 550 of cover plate 540 comprises linear side walls 555 that are configured to avoid engagement with the keyway 270 of rotor disk 104. Plate key 550 extends from forward plate face 542 and comprises a forward key face 551 and a plurality of exterior surfaces 552. Exterior surfaces 552 may be configured to engage a notch 528 of the blade key 526. Plate key 550 may present, at a cross-section normal to the axis of rotation, a rectangle or square, to name merely a few non-limiting examples. One or more of exterior surfaces 552 may be tapered towards or chamfered to the forward key face 551.

Figure 5B:
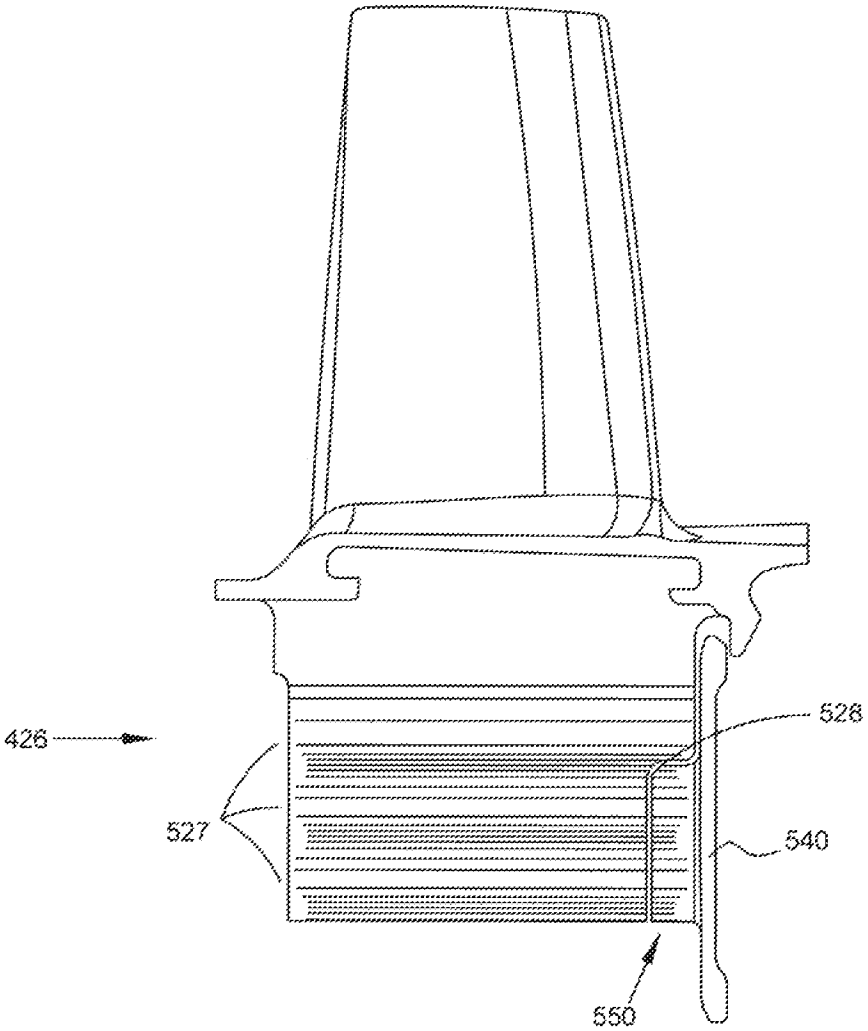
FIG. 5B is a profile view of a blade assembly with the rotor assembly cover plate depicted in FIG. 5A, in accordance with some embodiments of the present disclosure.
Figure 5C:
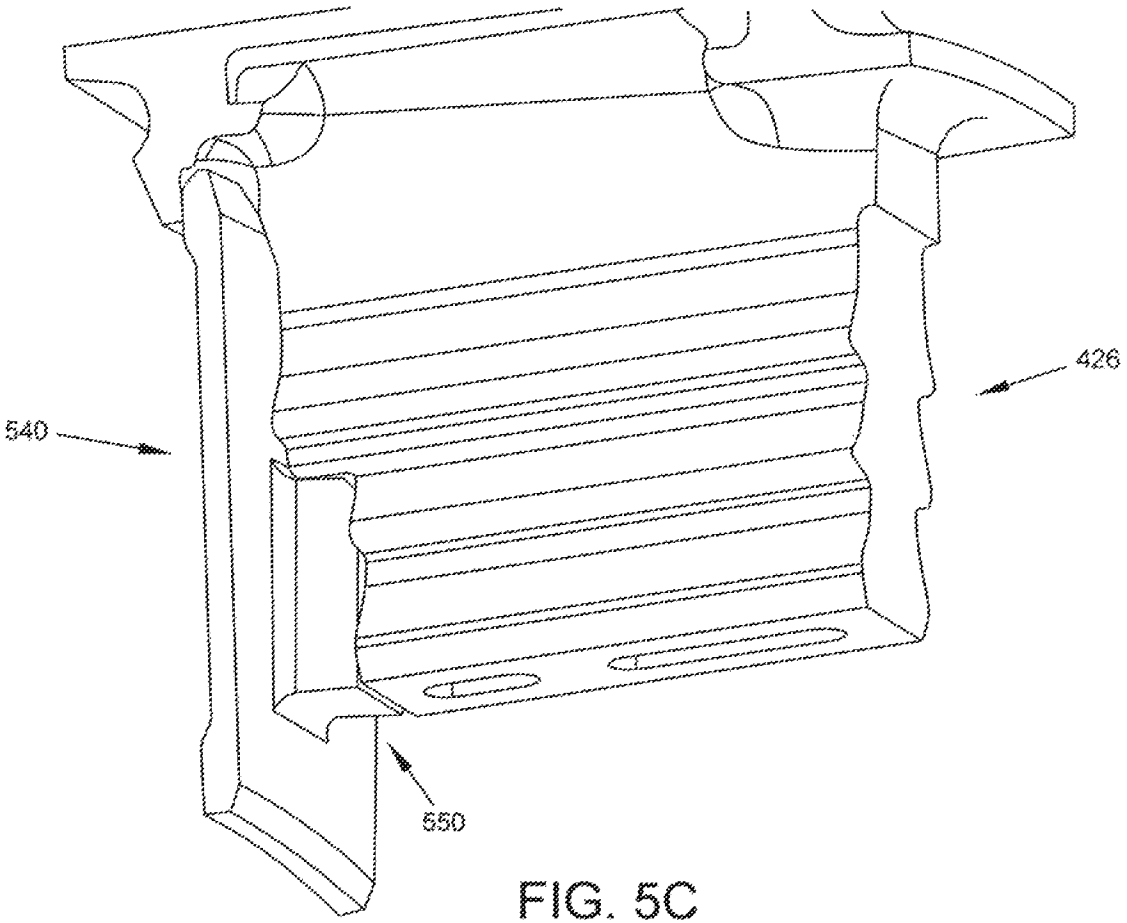
FIG. 5C is an isometric and cross-sectional view of a rotor disk and the rotor assembly cover plate depicted in FIG. 5A, in accordance with some embodiments of the present disclosure.
Figure 5D:
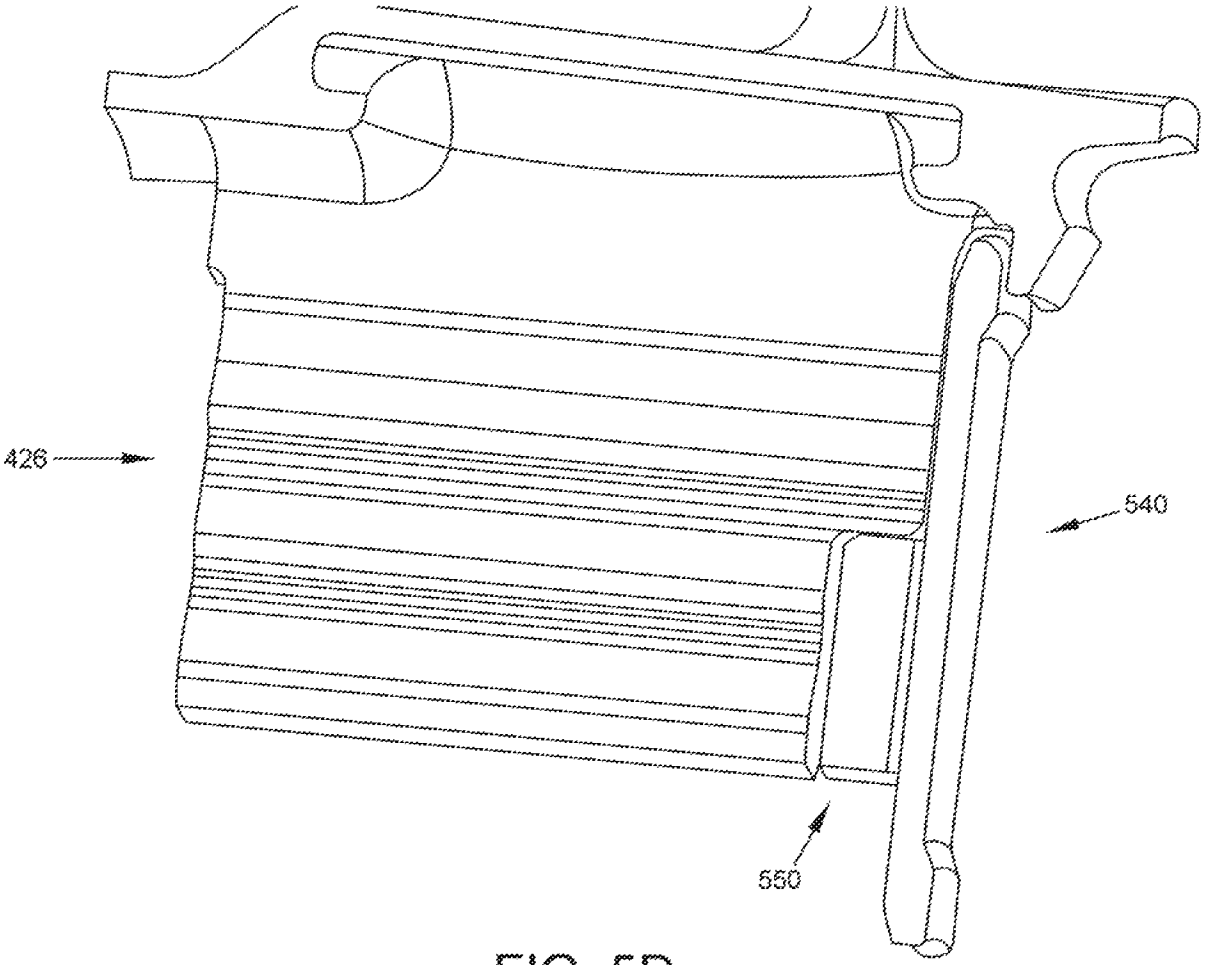
FIG. 5D is an isometric and cross-sectional view of a rotor disk and the rotor assembly cover plate depicted in FIG. 5A, in accordance with some embodiments of the present disclosure.
Figure 5E:
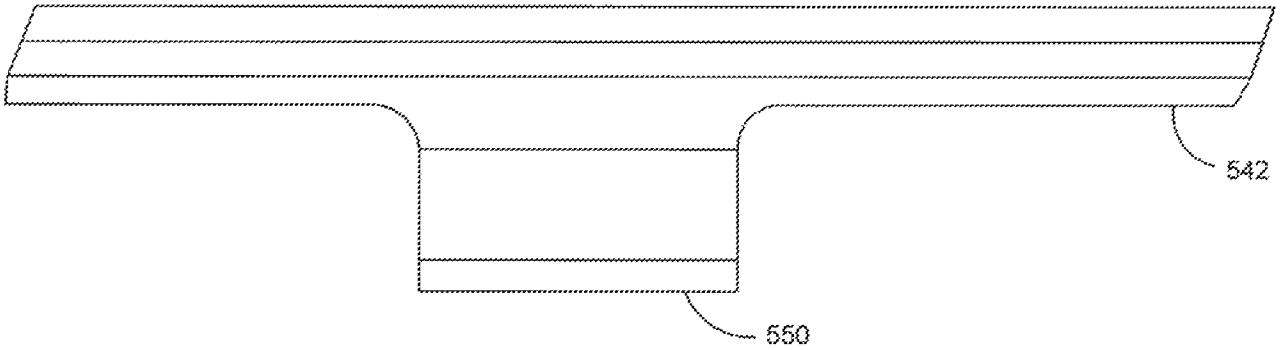
FIGS. 5E and 5F are a top profile view of the rotor assembly cover plate depicted in FIG. 5A, in accordance with some embodiments of the present disclosure where

As shown in FIG. 5B, the blade key 526 comprises a notch 528 configured to accommodate the plate key 550. The linear side walls 555 of plate key 550 do include any ridges or features that align with the ridges 527 of the blade key 526. The isometric views provided by FIGS. 5C and 5D similarly demonstrate that the linear side walls 555 of plate key 550 do include any ridges or features that align with the ridges 527 of the blade key 526. FIG. 5E presents a top profile view of the cover plate 540 to illustrate that, in some embodiments, the plate key 550 extends axially forward normal to the forward plate face.

Figure 5F:
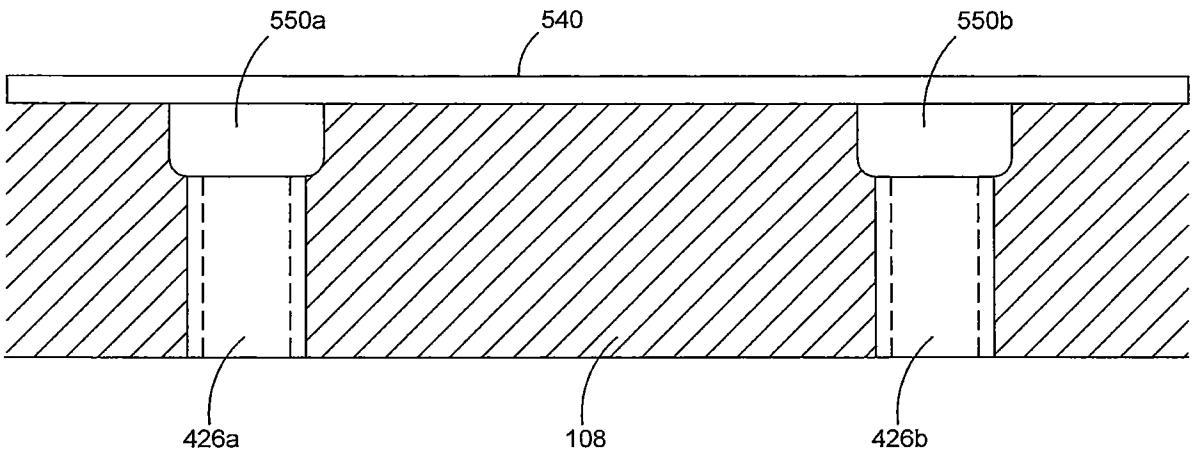

In the embodiment disclosed in FIGS. 5A through 5F, the radially outward surface of the plate key 550 acts as the load transferring surface to the blade key 526. Load is not directly transferred to the rotor disk 104. However, load is directed away from the blade groove 164, which improves the load profile of the blade assembly 520 during operation. FIG. 5F shows the plate 540 with multiple plate keys 550*a* and 550*b* interacting with keyways in the disc 108 associated with blade keys 426*a* and 426*b* respectively.

The present disclosure further provides methods for both axially retaining a blade assembly relative to a rotor disk and reducing or eliminating the centrifugal loading of the blade assembly and/or blade skirt. A method may comprise providing a cover plate having a plate key configured to engage a keyway of a rotor disk and/or the blade key of a blade assembly. The method may further comprise rotating a rotor disk having a disk keyway engaged by a plate key of a cover plate, wherein during rotation of the rotor disk and cover plate the centrifugal load of the cover plate is transferred from the cover plate to the rotor disk via the plate key—keyway engagement.

The present disclosure further provides methods of assembling a rotor assembly. In some embodiments, a method comprises engaging a cover plate having a plate key with the keyway of a rotor disk, and then engaging the blade key of a blade assembly with the keyway of the rotor disk. The cover plate may reduce or prevent axial movement of the blade assembly, and the centrifugal load of the cover plate may be transferred from the cover plate to the rotor disk via the plate key—keyway engagement.

The present disclosure provides numerous advantages over prior art rotor assemblies and rotor assembly cover plates. Most significantly, the cover plate segments disclosed herein allow for centrifugal force loading of the cover plate segment to be transferred directly to the rotor disk rather than first transferred to the blade assembly. By reducing or eliminating the loading of the blade assembly by the cover plate segment, the blade assembly may require less reinforcement and may therefore be lighter. Weight reduction of rotor assemblies carries substantial advantage, particularly in the field of aviation engines. Additionally, reducing or eliminating the loading of the blade assembly by the cover plate segment likewise reduces the stresses incurred at the blade groove, thus reducing the rate of premature failure of the blade assemblies and/or increasing the service life of such an assembly. In some embodiments the mass of the cover plate may be reduced as a result of the improved load paths.

According to aspects of the present disclosure, a rotor assembly may comprise a rotor disk concentric with an axis of rotation having a plurality of axially-extending keyways arranged around the outer circumference of the disk, a plurality of blade assemblies, and a plurality of cover plate segments. Each of the plurality of blade assemblies comprises a blade, a blade skirt, and a blade key. The blade skirt is positioned between the blade and the key, the key having a shape being complimentary to the keyway of the disk and received in the keyway such that the blade assembly is restrained from relative movement in the radial and circumferential directions. Each of the plurality of cover plate segments form a respective portion of an annular cover plate ring concentric with the axis of rotation, each of the plurality of cover plate segments having a front plate face and a back plate face each normal to the axis and having a thickness in the axial direction less than the radial width of each segment. The front and back plate face have a radially outer portion, radially inner portion, and a plate key extending from the front plate face of the cover plate segment that is received in a portion of the keyway. Each front plate face of the plurality of cover plate segments engage one or more blade keys and the radially outer portions engage a blade groove defined by the blade skirt and the radially inner edges engage a disk groove in the disk restricting relative axial movement of the blade assembly with respect to the disk. The plate key engages the portion of the keyway or the blade key restricting radial movement of the cover plate segment.

In some embodiments the keyway comprises a plurality of axially-extending recesses and the blade key has a corresponding plurality of complimentary axially-extending ridges. In some embodiments the plate key has at least one axially extending ridge corresponding to one or more of the plurality of axially-extending recesses of the keyway. In some embodiments the plate key has a plurality of axially extending ridges corresponding to the plurality of axially-extending recesses of the keyway.

In some embodiments the blade key comprises a radially inner portion with a axial length less than the axial extent of the keyway. In some embodiments the plate key has an axial length less than or equal to the axial extent of the keyway. In some embodiments the plate key engages the keyway. In some embodiments the plate key engages the blade key. In some embodiments the number of the plurality of cover plate segments is equal to the number of the plurality of keyways.

According to another aspect of the present disclosure, a cover plate for maintaining axial alignment between a blade assembly and a rotor disk comprises a plurality of substantially flat arcurate segments, each segment having an outer portion and inner portion with respect to the radial direction; a forward surface substantially normal to an axial direction defined by the arcurate segment; and a key extending in the axial direction from the forward surface, the key configured to be received within a keyway defined in the rotor disk.

In some embodiments the key comprises a plurality of teeth complimentary to recesses in the keyway. In some embodiments the key has an axial width less than the axial width of the keyway proximate the key. In some embodiments each of the segments have a plurality of keys.

According to still further aspects of the present disclosure, a blade assembly for attachment to a rotor disk comprises a blade attached to a blade skirt; a key extending downward from the blade skirt and comprising a plurality of horizontally oriented ridges extending lengthwise from the front to the rear on oppositely disposed sides and a notch formed in a back portion of the key; and, a skirt, wherein the skirt comprises an upper surface substantially perpendicular to the blade and defining a boundary of a fluid passage, and a downward opening slot formed in an aft portion of the skirt.

In some embodiments the notch begins on the bottom of the key and extends partially up the key. In some embodiments the notch has a rectangular cross section viewed normal to the axis of rotation. In some embodiments the notch begins above the bottom of the key and extends partially up the key. In some embodiments a surface defining the radially outward portion of the notch is slanted. In some embodiments the notch extends from one oppositely disposed, side to the other. In some embodiments the notch is buried within the oppositely disposed sides.

The present application discloses one or more of the features recited in the appended claims and/or the following features which, alone or in any combination, may comprise patentable subject matter.

Although examples are illustrated and described herein, embodiments are nevertheless not limited to the details shown, since various modifications and structural changes may be made therein by those of ordinary skill within the scope and range of equivalents of the claims.

What is claimed is:

1. A rotor assembly comprising:

a rotor disk concentric with an axis of rotation having a plurality of axially-extending keyways arranged around the outer circumference of the disk, wherein each of the axially-extending fir tree keyways defines a plurality of axially extending recesses;

a plurality of blade assemblies, each of the plurality of blade assemblies comprising a blade, a blade skirt, and a fir tree blade key; the blade skirt positioned between the blade and the fir tree blade key; each fir tree blade key having a shape including a plurality of axially extending, circumferentially oriented blade key ridges, the shape being complimentary to a respective fir tree keyway of the plurality of fir tree keyways of the rotor disk and received in the respective fir tree keyway such that each of the respective blade assemblies of the plurality of blade assemblies are restrained from relative movement in the radial and circumferential directions, wherein each fir tree blade key defines an axial notch extending a full circumferential width of the fir tree blade key and part of a radial height of the fir tree blade key; and, a plurality of cover plate segments; each of the plurality of cover plate segments forming a respective portion of an annular cover plate ring concentric with the axis of rotation, each of the plurality of cover plate segments having a front plate face and a back plate face each normal to the axis and having a thickness in the axial direction less than the radial width of each segment, the front and back plate face having a radially outer portion, radially inner portion, and a plate key extending from the front plate face of the cover plate segment that is received in a portion of the respective fir tree keyway at the axial notch of the respective fir tree blade key, wherein the plate key comprises a shape including a plurality of axially extending, circumferentially oriented plate key ridges, the shape being complimentary to a portion of a respective fir tree keyway of the plurality of fir tree keyways of the rotor disk corresponding to the axial notch in the respective fir tree blade key, wherein the plate key ridges axially align with the axially extending, circumferentially oriented blade key ridges and engage with corresponding axially extending recesses of the respective fir tree keyway, and wherein the plate key extends less than a full radial length of the respective fir tree keyway;

wherein, each front plate face of the plurality of cover plate segments engage one or more of the respective blade keys and the radially outer portions engage a blade groove defined by the blade skirt and the radially inner portions engage a disk groove in the disk restricting relative axial movement of the blade assembly with respect to the rotor disk; and the plate key engages the portion of the fir tree keyway restricting radial movement of the cover plate segment.

2. The rotor assembly of claim 1, wherein the plurality of axially-extending recesses in each keyway and the plurality of complimentary axially-extending ridges of each blade key correspond to each other.

3. The rotor assembly of claim 1, wherein the blade key comprises a radially inner portion with an axial length less than the axial extent of the keyway.

4. The rotor assembly of claim 3, wherein the plate key has an axial length less than or equal to the axial extent of the keyway.

5. The rotor assembly of claim 1, wherein the plate key engages the blade key.

6. The rotor assembly of claim 1, wherein the number of the plurality of cover plate segments is equal to the number of the plurality of keyways.

7. A cover plate for maintaining axial alignment between a blade assembly and a rotor disk comprising:

a plurality of flat arcuate segments, each segment having an outer portion and inner portion with respect to a radial direction, and a forward surface normal to an axial direction defined by the arcuate segment; and a key extending in the axial direction from the forward surface, the key configured to be received within a fir tree keyway defined in the rotor disk for retaining the blade assembly at an axial notch of a fir tree blade key that is also received within the fir tree keyway, wherein the plate key comprises a shape including a plurality of axially extending, circumferentially oriented plate key ridges, the shape being complimentary to a portion of the fir tree keyway of the rotor disk corresponding to the axial notch in the fir tree blade key, wherein the plate key ridges are configured to axially align with axially extending, circumferentially oriented blade key ridges and engage with corresponding axially extending recesses of the fir tree keyway, and wherein the plate key is configured to extend less than a full radial length of the fir tree keyway.

8. The cover plate of claim 7, wherein the key has an axial width less than the axial width of the keyway proximate the key.

9. The cover plate of claim 7, wherein each of the segments have keys.

* * * * *